US009657999B2

(12) United States Patent
Newman et al.

(10) Patent No.: US 9,657,999 B2
(45) Date of Patent: May 23, 2017

(54) ALTERNATING CHANNEL HEAT EXCHANGER

(71) Applicant: NORTHROP GRUMMAN SYSTEMS CORPORATION, Falls Church, VA (US)

(72) Inventors: Robb Newman, Redondo Beach, CA (US); Alex McCloskey, Venice, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 321 days.

(21) Appl. No.: 14/538,375

(22) Filed: Nov. 11, 2014

(65) Prior Publication Data

US 2016/0131441 A1 May 12, 2016

(51) Int. Cl.

| | |
|---|---|
| ***F28F 3/00*** | (2006.01) |
| ***F28F 3/12*** | (2006.01) |
| ***F28F 9/02*** | (2006.01) |
| ***F28F 7/02*** | (2006.01) |

(52) U.S. Cl.

CPC ..... *F28F 3/005* (2013.01); *F28F 3/12* (2013.01); *F28F 7/02* (2013.01); *F28F 9/028* (2013.01); *F28F 2009/0287* (2013.01)

(58) Field of Classification Search

USPC ..... 165/166, 164, 165, 167

See application file for complete search history.

(56) References Cited

U.S. PATENT DOCUMENTS 2,537,276 A * 1/1951 McMahon ..... F28F 3/086 165/166
2,656,159 A * 10/1953 Hammond ..... F28F 3/086 165/166
3,165,152 A 1/1965 Jones
3,825,061 A 7/1974 Bathla (Continued)

FOREIGN PATENT DOCUMENTS

WO WO 2010/082382 A1 7/2010

OTHER PUBLICATIONS

HiETA Technologies, http://www.hieta.biz/, Web Sep. 19, 2014.

(Continued)

*Primary Examiner* — Justin Jonaitis
(74) *Attorney, Agent, or Firm* — John A. Miller; Miller IP Group, PLC

(57) ABSTRACT

A lightweight, high-efficiency alternating channel counter-flow heat exchanger structure is disclosed. A matrix of alternating hot and cold channels defining a heat exchanger structure is provided. A portion of each of the inlets and outlets of each of the hot and cold channels is blocked to prevent fluid flow through the blocked portion, thus creating hot-only and cold-only fluid communication regions on the ends of the heat exchanger structure. Alternating hot and cold headers provided on each end of the heat exchange structure service the respective hot and cold channels. The partial blocking structures on the channel-ends enable a single hot or cold header/plenum to be offset with respect to individual rows of channels and thus service a pair of adjacent rows of alternating hot and cold channels in the matrix of channels. The true alternating channel counter-flow design provides a higher heat transfer rate than a similarly-sized cross-flow design.

19 Claims, 7 Drawing Sheets

(56) References Cited

U.S. PATENT DOCUMENTS 3,907,032 A * 9/1975 DeGroote ..... F28D 1/05366 165/143
4,147,210 A * 4/1979 Pronko ..... F28F 1/44 165/154
4,384,611 A 5/1983 Fung
4,460,388 A 7/1984 Fukami et al.
4,520,863 A * 6/1985 Andres ..... F28D 1/0246 165/104.14
4,715,433 A * 12/1987 Schwarz ..... F25J 3/04412 165/110
5,309,637 A 5/1994 Moriarty
5,725,051 A * 3/1998 Veltkamp ..... F28F 21/06 165/164
6,076,598 A 6/2000 Doi et al.
6,228,341 B1 * 5/2001 Hebert ..... B01J 19/249 423/352
6,910,528 B2 6/2005 Abiko et al.
7,188,665 B2 3/2007 Arai et al.
7,285,153 B2 * 10/2007 Bruun ..... F23C 13/00 165/165
9,134,072 B2 9/2015 Roisin et al.
2005/0217837 A1 * 10/2005 Kudija, Jr. ..... F28D 7/0008 165/165
2008/0105418 A1 5/2008 Takada et al.
2011/0180242 A1 7/2011 Urata et al.
2013/0140010 A1 6/2013 Parfenov
2013/0264031 A1 * 10/2013 Plourde ..... B23P 15/26 165/104.11

OTHER PUBLICATIONS

Heat exchanger, http://en.wikipedia.org/wiki/Heat_exchanger, Web Sep. 18, 2014.
Klingenbur Energy Recovery, http://www.klingenburg.de/en/products/cf-plate-heat-exchanger.html, Web Sep. 18, 2014.
McCarthy, D. L. et al., "Creating Complex Hollow Metal Geometries Using Additive Manufacturing and Electroforming" Aug. 22, 2012, pp. 108-120.
Kragh, J. et al. "New counter flow heat exchanger designed for ventilation systems in cold climates" Energy and Buildings, vol. 39, 2007, pp. 1151-1158.
Neugebauer, Reimund, "Additive Manufacturing Boosts Efficiency of Heat Transfer Components" Emerald Insight, Assembly Automation Journal, vol. 31, Issue 4, 2011, pp. 344-347.

* cited by examiner

ALTERNATING CHANNEL HEAT EXCHANGER

BACKGROUND

Field

This invention relates generally to a high-efficiency alternating channel counter-flow heat exchanger and, more particularly, to a heat exchanger configured with a matrix of separated hot fluid flow channels and cold fluid flow channels, where the hot channels and the cold channels alternate in each row and each column such that hot channels are adjacent only to cold channels and vice versa, and where the alternating channel counter-flow arrangement is enabled by channel-end flow blockers and a header/plenum for simplifying the plumbing of the hot and cold fluids.

Discussion

Heat exchangers have been used for decades to transfer heat energy from one fluid to another. In a typical application, a hot fluid is cooled by a secondary cool fluid. The hot fluid flows through a first passage, such as a tube or channel, and the cold fluid can either flow through a second passage or can flow freely over fins which are fixed to the first passage. The fluids can both be liquids, they can both be gases, or one can be a liquid and the other can be a gas, such as air.

In constrained-flow heat exchangers, where both fluids flow through channels or passages, there are three primary classifications of heat exchangers, according to their flow arrangement. In a cross-flow heat exchanger, the hot and cold fluids travel roughly perpendicular to one another through the heat exchanger. In parallel-flow heat exchangers, the two fluids enter the heat exchanger at the same end, and travel in parallel to one another to the other end. In counter-flow heat exchangers, the two fluids enter the heat exchanger from opposite ends. The counter-flow design is the most efficient, in that it can transfer the most heat between the fluids due to the fact that the average temperature difference along any unit length is greater.

One way of increasing heat exchanger efficiency is to increase the number of channels through which fluid flows, and decrease the size of the channels. Small channel size enables more complete transfer of heat energy from the hot fluid to the cold fluid for a given heat exchanger length. One heat exchanger design is essentially a cubic matrix of channels arranged in rows and columns, with the number of rows and columns in the hundreds, and the number of channels in the tens of thousands. In such a complex and intricate heat exchanger structure, although the efficiency benefits of a counter-flow arrangement would be desirable, it has not been possible or practical to fabricate such a design until now.

DETAILED DESCRIPTION OF THE EMBODIMENTS

The following discussion of the embodiments of the invention directed to an alternating channel counter-flow heat exchanger is merely exemplary in nature, and is in no way intended to limit the invention or its applications or uses.

Heat exchangers are widely used to transfer heat energy from a first, hot fluid to a second, cool fluid. Heat exchangers are used in a wide range of industries and applications—from automotive radiators, to aerospace applications such as engine oil cooling and jet fuel preheating, to various applications in power generation and computing. The objective in heat exchanger design is to maximize heat transfer efficiency in order to minimize heat exchanger size/weight and required fluid flow rates.

Figure 1:
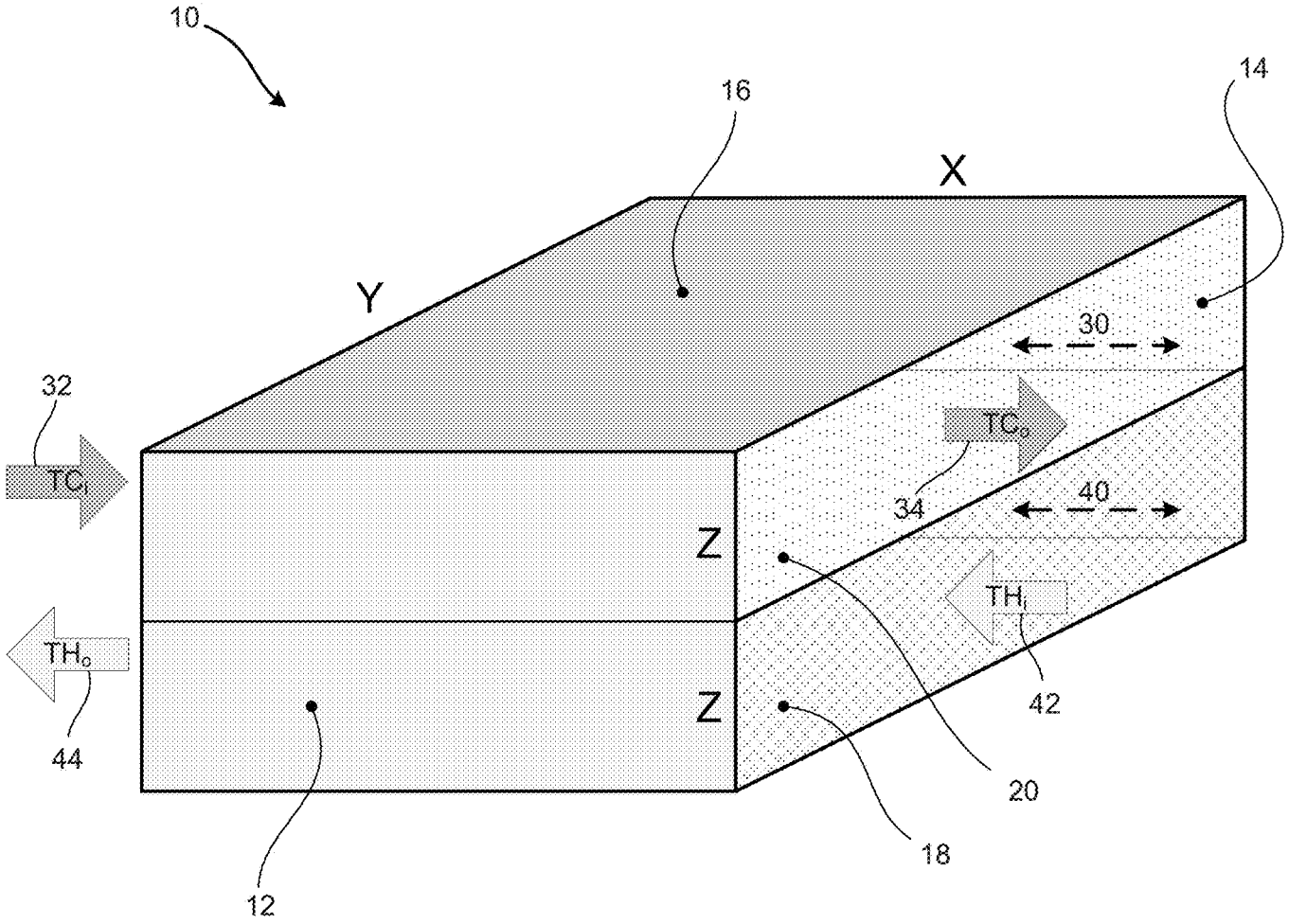
FIGURE 1 (Prior Art)
FIG. 1 is an illustration of a simple two channel counter-flow heat exchanger of a type known in the art.

FIG. 1 is an illustration of a simple two channel counter-flow heat exchanger 10 of a type known in the art. In counter-flow heat exchangers such as the heat exchanger 10, the two fluids enter the heat exchanger from opposite ends. The counter-flow design is the most efficient type of heat exchanger, in that it can transfer the most heat between the fluids due to the fact that the average temperature difference along any unit length is greater.

The heat exchanger 10 includes a first side wall 12 and a second side wall 14. The heat exchanger 10 also includes a top plate 16, a bottom plate 18 and a middle plate 20. The ends of the heat exchanger 10 are open, thus defining a first (upper) channel 30 and a second (lower) channel 40. A cold fluid enters the channel 30 at a cold fluid inlet temperature ($TC_i$) as shown at arrow 32. The cold fluid exits the channel 30 at a cold fluid outlet temperature ($TC_o$) as shown at arrow 34. A hot fluid enters the channel 40 at a hot fluid inlet temperature ($TH_i$) as shown at arrow 42. The hot fluid exits the channel 40 at a hot fluid outlet temperature ($TH_o$) as shown at arrow 44. The hot fluid and the cold fluid may each be either liquid or gas. In one example, the hot fluid is a liquid and the cold fluid is cool air. The heat exchanger 10 would typically be made of aluminum, or some other material that has both light weight and good conductive heat transfer properties.

Each channel of the heat exchanger 10 has a length X, a width Y and a height Z, where the length X is measured from end to end in the direction of fluid flow through the channels 30 and 40, the height Z is measured in the vertical direction as shown, and the width Y is measured in the direction perpendicular to both X and Z. The total heat transfer in the heat exchanger 10 is proportional to a product of a heat transfer coefficient, the hot-side heat transfer area, and the hot-to-cold temperature differential. That is:

$$Q \propto h \cdot XY[\overline{T_H} - \overline{T_C}] \quad (1)$$

Where h is the net heat transfer coefficient, XY is the hot-side area defined by the length X multiplied by the width Y, and $\overline{T_H}$ and $\overline{T_C}$ are the hot and cold fluid average temperatures (difference between inlet and outlet temperature), respectively.

While the heat exchanger 10 is a counter-flow design, it is not fully optimized due to the large size of the channels 30 and 40. A design with smaller channels and more heat exchange surface area can increase efficiency.

Figure 2:
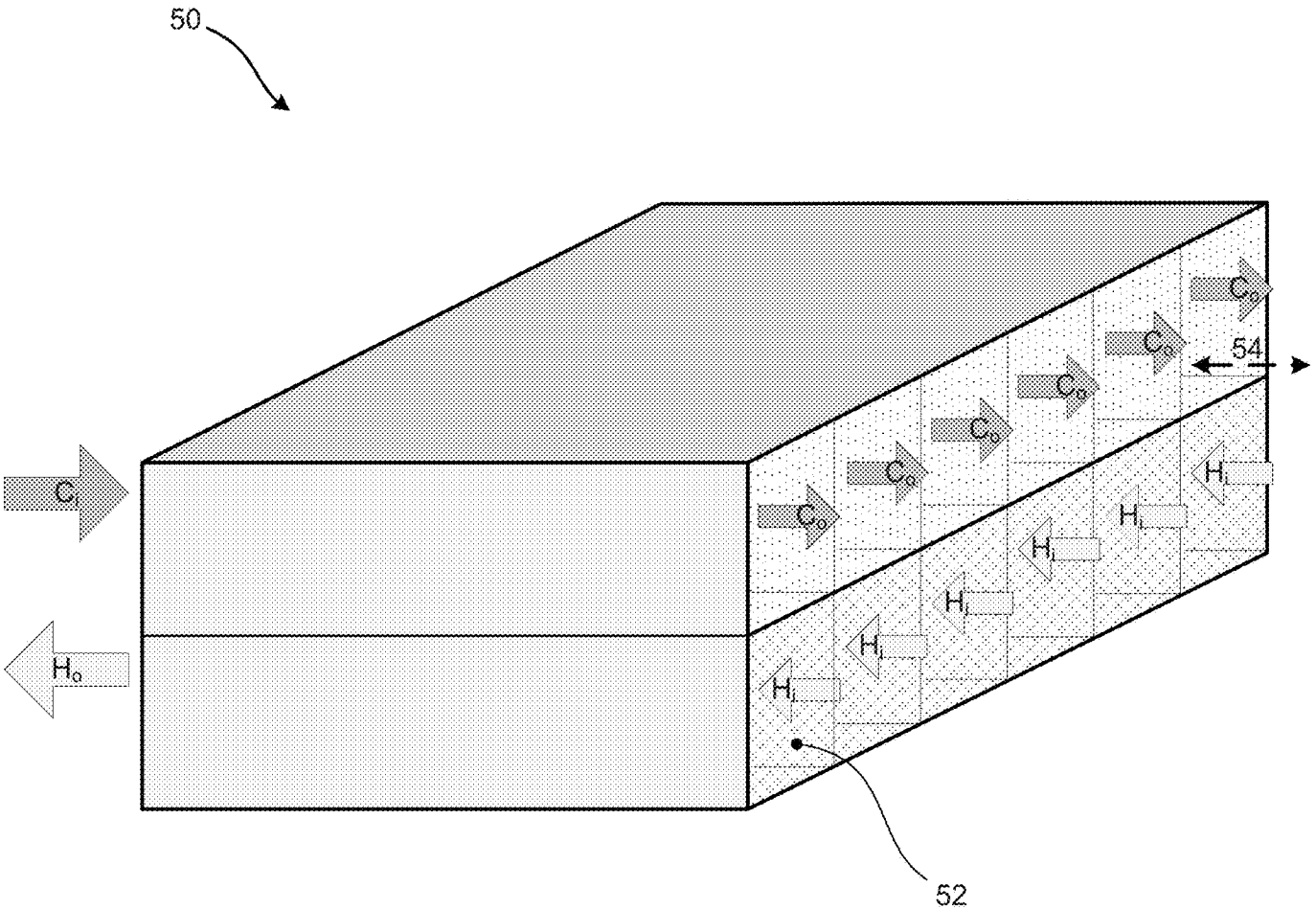
FIGURE 2 (Prior Art)
FIG. 2 is an illustration of a simple counter-flow heat exchanger with fins added in each of the two main channels.

FIG. 2 is an illustration of a simple counter-flow heat exchanger 50 which is similar to the heat exchanger 10 but with vertical fins added in each of the two main channels. A series of vertical fins 52 are incorporated between the top plate 16 and the middle plate 20, and the middle plate 20 and the bottom plate 18, respectively. The fins 52 define a plurality of channels 54 which are much smaller than the channels 30 and 40 of the heat exchanger 10 in FIG. 1. It can be seen that heat exchanger 50 is still partially a counter-flow design, in that the upper layer of the channels 54 handles the cold fluid flowing in one direction, and the lower layer of the channels 54 handles the hot fluid flowing in the opposite direction. This fluid flow arrangement is simple and practical from a plumbing connection standpoint, as all of the cold fluid channels are adjacent to each other and all of the hot fluid channels are adjacent to each other.

The theoretical heat transfer in the heat exchanger 50 can be defined as:

$$Q_{theoretical} \propto h(XY+10ZX)[\overline{T_H}-\overline{T_C}] \quad (2)$$

Where the hot-side wetted area now includes a term 10ZX, which represents the area of the fins in the channels 54. However, the fins 52 in the heat exchanger 50 do not directly conduct heat from hot fluid to cold fluid, so there is a "fin efficiency" to account for. Thus, the actual heat transfer in the heat exchanger 50 can be defined as:

$$Q_{actual} \propto h(XY+\eta \cdot 10ZX)[\overline{T_H}-\overline{T_C}] \quad (3)$$

Where $\eta$ is the fin efficiency factor.

The small size of the channels 54 and the additional heat exchange surface area offered by the fins 52 make the heat exchanger 50 more efficient than the heat exchanger 10. However, efficiency could be further increased by increasing the degree of counter-flow.

Figure 3:
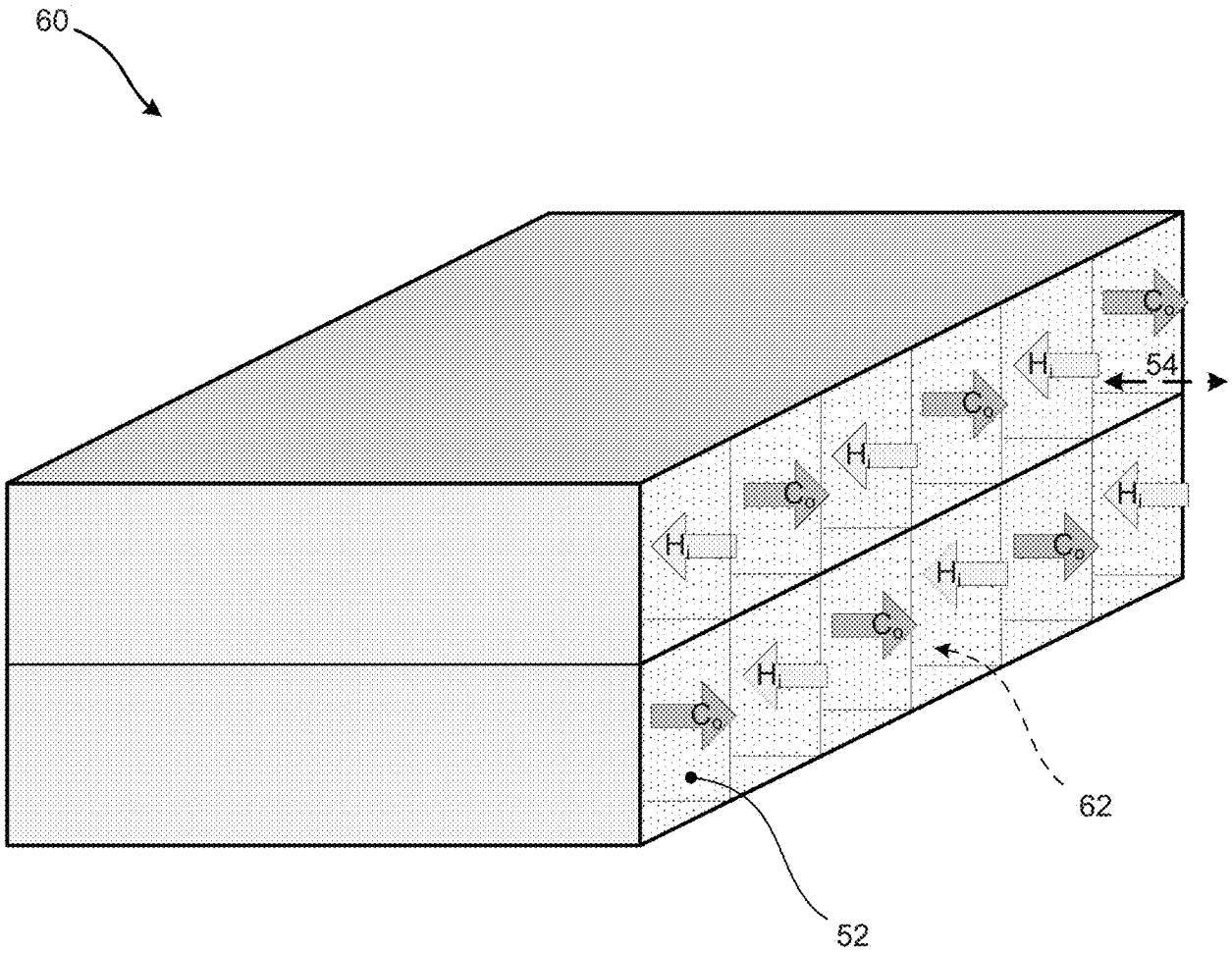
FIG. 3 is an illustration of a true alternating channel counter-flow heat exchanger, where each channel is adjacent only to channels carrying the other fluid in the opposite direction.

FIG. 3 is an illustration of a true alternating channel counter-flow heat exchanger 60, where each channel is adjacent only to channels carrying the other fluid in the opposite direction. The heat exchanger 60 is identical in construction to the heat exchanger 50, including the vertical fins 52 and the plurality of channels 54. The only difference with the heat exchanger 60 is the fluid flow arrangement, where the channels 54 alternate in type of fluid carried and direction of flow, in both the lateral and vertical direction. That is, each of the channels 54 has only counter-flowing channels adjacent to it. For example, consider channel 62, which is near the middle of the bottom layer of channels and which has a hot fluid inlet at the right-hand end of the heat exchanger. It can be seen in FIG. 3 that the channel 62 has a counter-flowing cold fluid channel as its neighbors above, to the left and to the right. Thus, the heat exchanger 60 is a true alternating channel counter-flow design.

In the heat exchanger 60, there is no longer an "effective" fin area, as all of the fin surfaces now provide direct conduction from the hot fluid to the cold fluid. Thus, the actual heat transfer is equal to the theoretical heat transfer in the heat exchanger 60, as follows:

$$Q_{actual}=Q_{theoretical} \propto h(XY+10ZX)[\overline{T_H}-\overline{T_C}] \quad (4)$$

That is, the fin efficiency $\eta$ is equal to one.

As shown above, the heat exchanger 60 is ideal from a heat transfer efficiency standpoint. Unfortunately, as a practical matter, it would be extremely labor intensive to build the heat exchanger 60 with all of the requisite hot and cold fluid plumbing connections. This is particularly apparent when it is considered that many real-world applications require heat exchangers with hundreds of rows and hundreds of columns of channels. Clearly, there is no practical way to build such a device. Thus, the benefits of an alternating channel counter-flow heat exchanger have been unobtainable until now.

Figure 4:
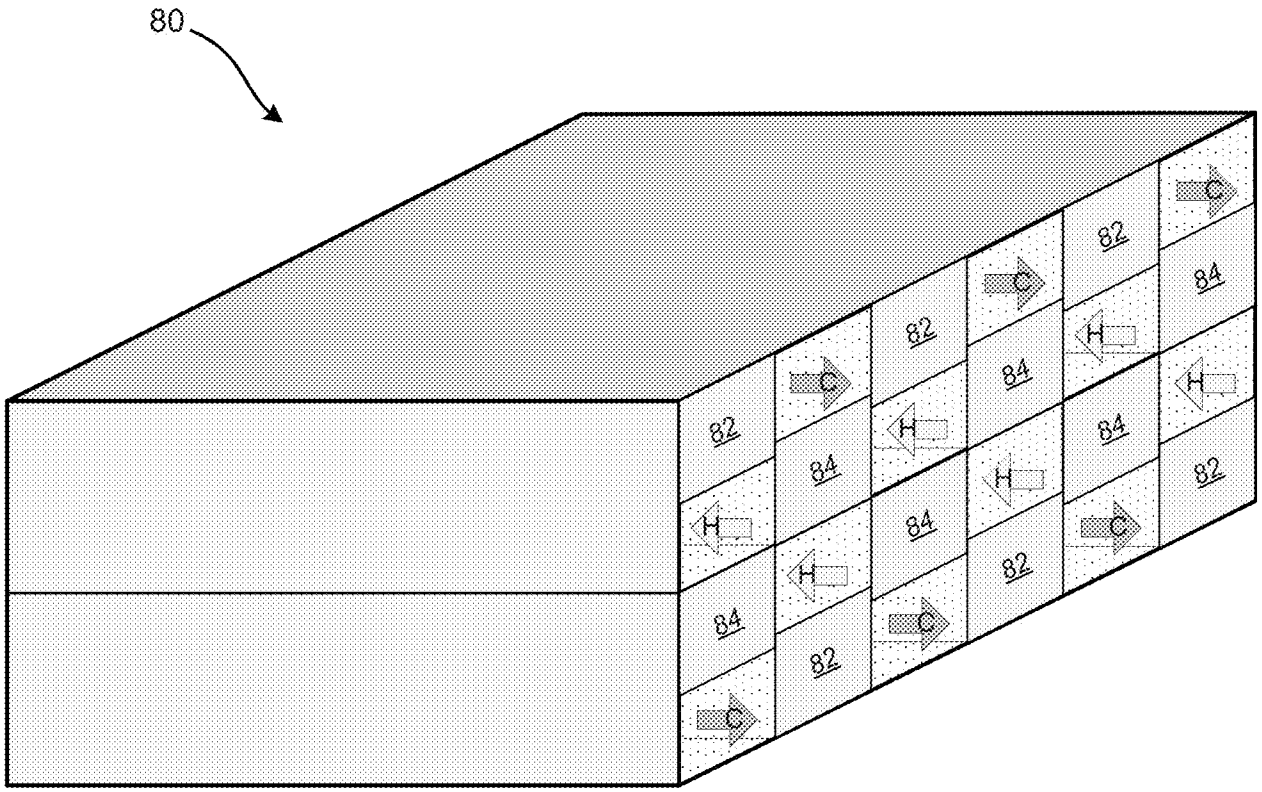
FIG. 4 is a first illustration of a true alternating channel counter-flow heat exchanger, showing how channel-end blockers can be used to simplify plumbing of the fluids to the heat exchanger.

FIG. 4 is a first illustration of a true alternating channel counter-flow heat exchanger 80, including design features which make it possible to construct and route fluids to the heat exchanger 80. The heat exchanger 80 starts with the same geometry as the heat exchanger 60, with two layers of the channels 54. However, in the heat exchanger 80, partial channel-end blockers are added on each end of the device, with a purpose and function that will become apparent in the following discussion. A plurality of hot channel-end blockers 82 is positioned over part of each end of each hot fluid channel. Specifically, the blockers 82 block the upper half of each of the hot fluid channels in the upper layer, and the blockers 82 block the lower half of each of the hot fluid channels in the lower layer. A corresponding set of the blockers 82 is also included at the opposite end (not visible in FIG. 4) of the heat exchanger 80. As a result of the blockers 82, all of the hot fluid openings are clustered together in a narrow vertical band, as seen in FIG. 4.

Similarly, a plurality of cold channel-end blockers 84 is positioned over part of each end of each cold fluid channel. Specifically, the blockers 84 block the lower half of each of the cold fluid channels in the upper layer, and the blockers 84 block the upper half of each of the cold fluid channels in the lower layer. A corresponding set of the blockers 84 is also included at the opposite end (not visible in FIG. 4) of the heat exchanger 80. As a result of the blockers 84, all of the cold fluid openings are clustered together in two narrow vertical bands—one at the top and one at the bottom of the heat exchanger 80.

It is emphasized here that each of the channels 54 in the heat exchanger 80 still has a full height Z, just as in the heat exchanger 60 of FIG. 3. It is only the end openings which are partially blocked by the blockers 82 and 84. The blockers 82 and 84 are shown in FIG. 4 as blocking a little more than half of each of the channel openings, as would be necessary to facilitate subsequent fabrication steps discussed below. It should be noted that the blockers 82 and 84 do not necessarily have to block half of the channel-end. For example, if the hot fluid is a liquid with a fairly low flow rate and the cold fluid is air with a high flow rate, it may be desirable to make the hot channel blockers 82 larger (for example, ⅔ height) and the cold channel blockers 84 smaller (for example, ⅓ height), so that the cold fluid experiences less of a flow obstruction. The opposite configuration is also possible—where the hot channel blockers 82 are made smaller and the cold channel blockers 84 are made larger.

Figure 5:
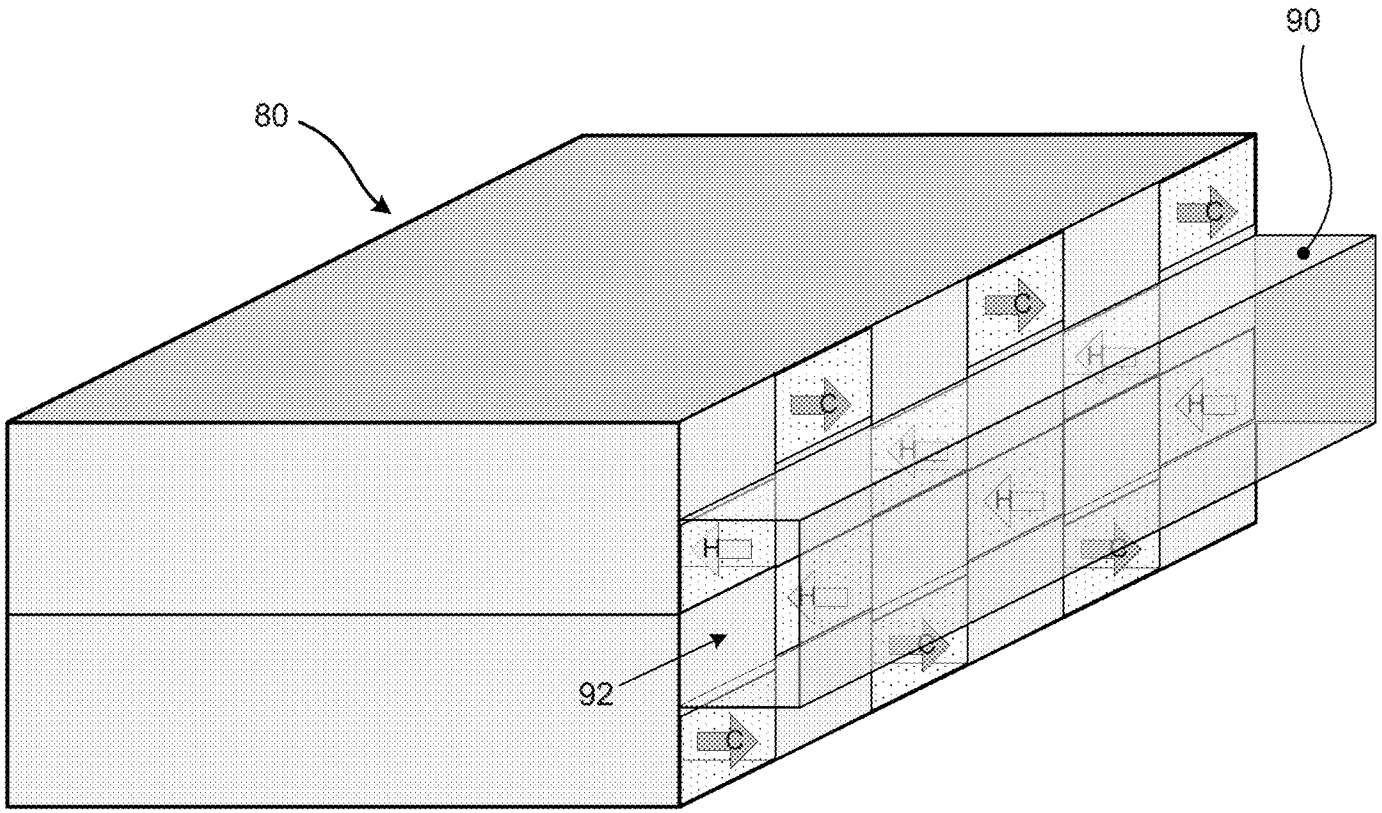
FIG. 5 is a second illustration of the heat exchanger of FIG. 4, showing how a header is used in conjunction with the channel-end blockers.

FIG. 5 is a second illustration of the heat exchanger 80 of FIG. 4. In FIG. 5, a plenum or header 90 has been added (shown semi-transparent), and is used in conjunction with the channel-end blockers 82 and 84 to greatly simplify the external plumbing. The header 90 has an open end 92, into which the hot fluid is inlet. From inside the header 90, the hot fluid can only flow into hot fluid channels, due to the presence of the blockers 84 on the cold fluid channels. After passing through the six half-height inlets, the hot fluid will fill the entire vertical height of each of the hot fluid channels. In fact, the half-height inlets may increase turbulence in the channels, with a beneficial increase in heat transfer coefficient.

Figure 6:
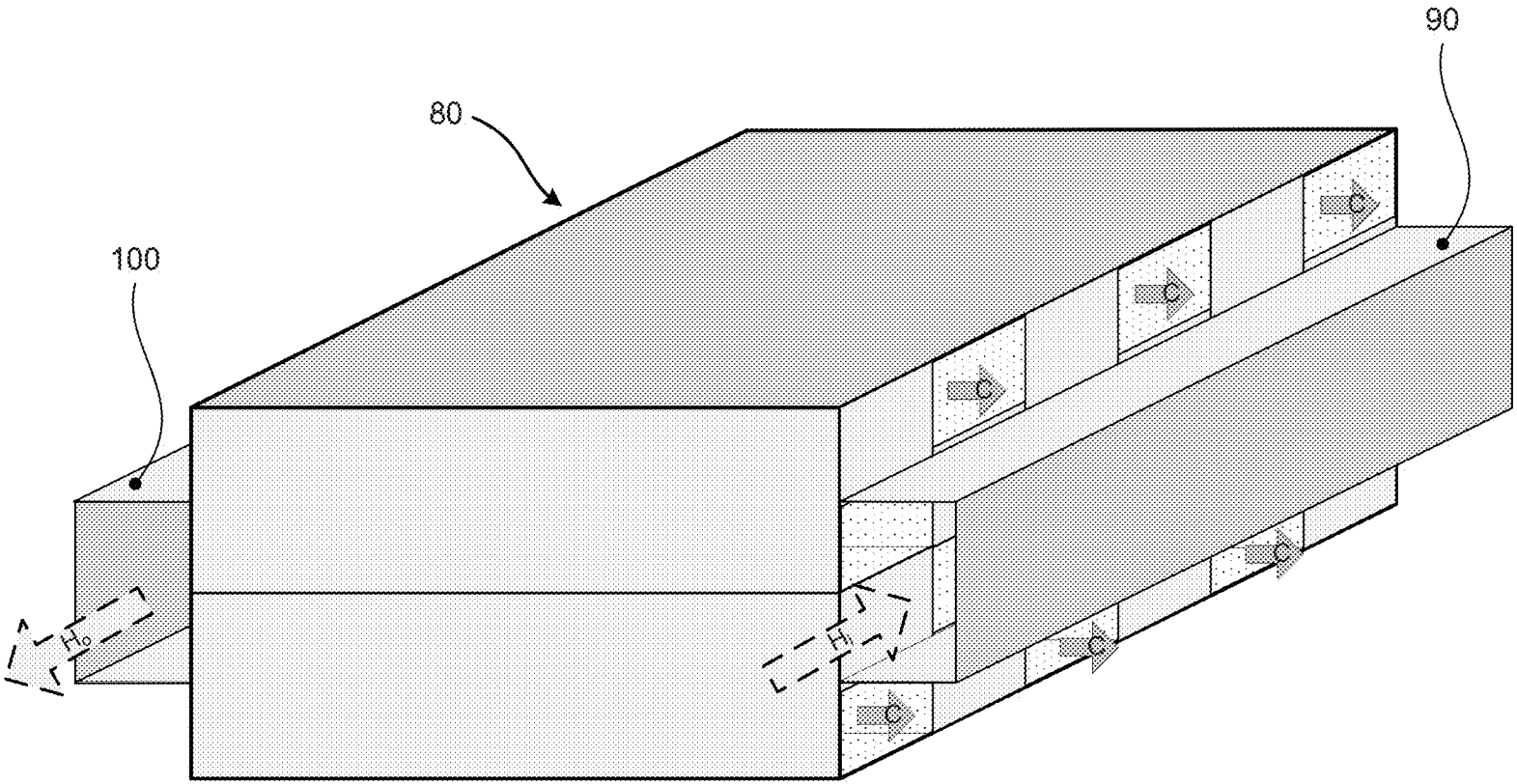
FIG. 6 is a third illustration of the heat exchanger of FIGS. 4 and 5.

FIG. 6 is a third illustration of the heat exchanger 80 of FIGS. 4 and 5. In FIG. 6, the header 90 is shown with solid walls and with the hot fluid flowing in at the open end 92. A second header 100 is also added, which receives the hot fluid exiting the heat exchanger 80 and delivers it through a single hot fluid outlet as shown at the left. Thus, it can be seen in FIG. 6 that the hot fluid plumbing to and from the heat exchanger 80 can be handled through a single inlet to the header 90 and a single outlet from the header 100. This is much simpler than the multiple hot fluid inlets and multiple hot fluid outlets required for the heat exchanger 60 of FIG. 3.

Two modes of handling the cold fluid are readily apparent in viewing FIG. 6. In a first mode where the cold fluid is a liquid, and closed-loop plumbing of the cold fluid is desired, then additional headers can be added—above and below the hot fluid headers 90 and 100—to handle the cold fluid. The cold fluid headers could have their inlets and outlets on the same side of the heat exchanger 80 as the hot fluid headers (that is, the "near side" in FIG. 6), or on the opposite side. In a second mode where the cold fluid is air, and the heat exchanger 80 can be placed in a cold air stream flowing in the X direction, then no plumbing or headers are needed for the cold fluid. In this case, the air will freely flow through the cold fluid channels, and will be blocked from entering the hot fluid channels by the headers 90 and 100.

The heat exchanger 80 can be made with two layers and many columns of very tall, narrow channels—thus offering tremendous hot-to-cold counter-flow surface area, but requiring only a single set of hot fluid headers. Such a design could be useful for many different applications. In one exemplary embodiment, the heat exchanger 80 has two layers and hundreds of columns of channels, with each channel being 4.5" tall and 0.03" wide.

Figure 7:
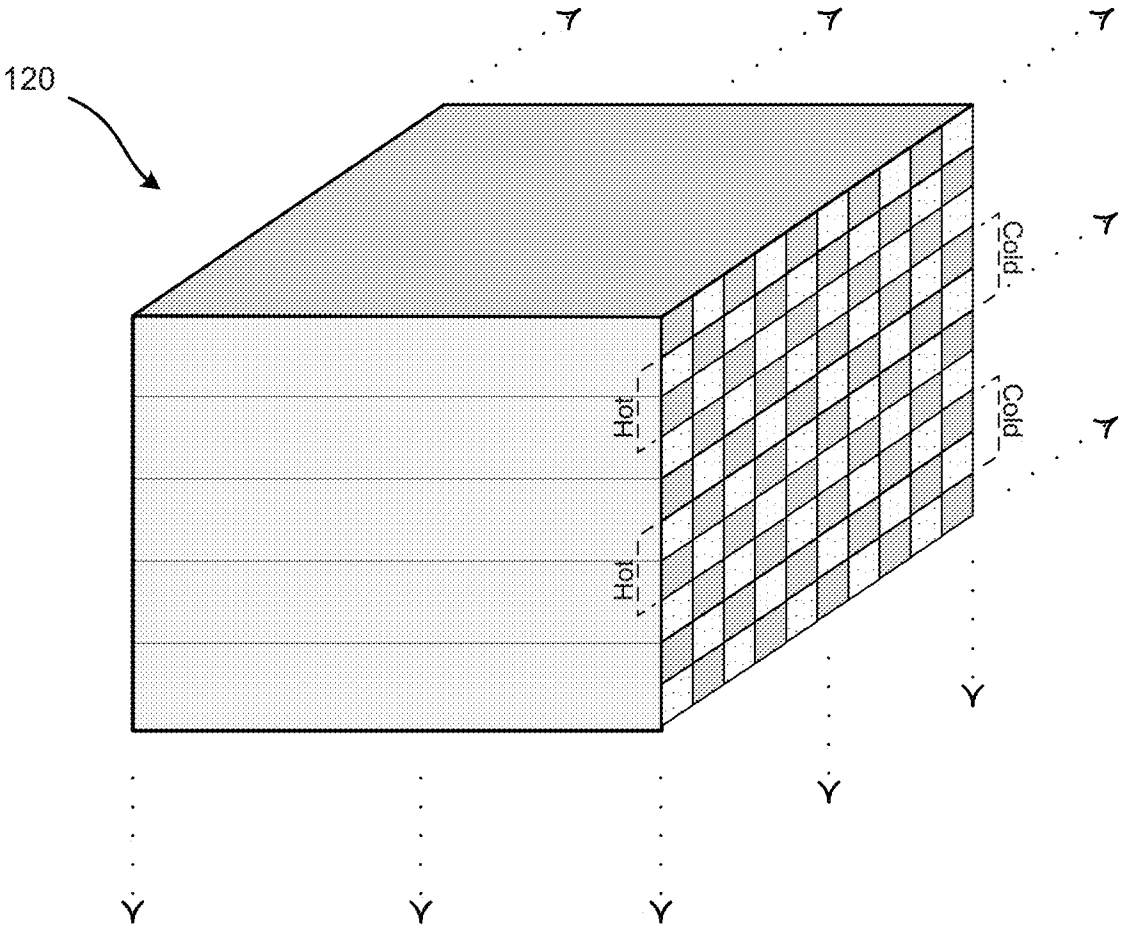
FIG. 7 is an illustration of an alternating channel counter-flow heat exchanger scaled up to include many rows and columns of channels.

FIG. 7 is an illustration of an alternating channel counter-flow heat exchanger 120 as it could be scaled up to include many rows and columns of channels. As mentioned previously, some real-world applications require heat exchangers with hundreds of rows and hundreds of columns of channels. The heat exchanger 120 of FIG. 7 shows just a small portion of such a device, which would continue on for many more rows (downward in the Z direction) and many more columns (in the Y direction). In either of the heat exchangers 80 or 120, the length of the channels (in the X direction) can be whatever is necessary for the application. In one exemplary embodiment, the heat exchanger 120 is a nine inch cube (9"×9"×9"), with 200 rows and 200 columns of channels, for a total of 40,000 channels, with each channel being square in cross-section.

In the heat exchanger 80, which included only two layers (rows) of channels, only a single hot fluid inlet header 90 and hot fluid outlet header 100 were needed. In the heat exchanger 120, it can be seen that many hot fluid inlet and outlet headers will be needed. Specifically, the hot fluid inlet and outlet headers would need to be placed over the $2^{nd}$ and $3^{rd}$ rows of openings from the top of the heat exchanger 120 (which equate to the bottom of the first row of channels and the top of the second row of channels), over the $6^{th}$ and $7^{th}$ rows of openings, etc. Similarly, if cold fluid headers are needed, they would be placed over the $1^{st}$ row of openings, the $4^{th}$ and $5^{th}$ rows of openings, the $8^{th}$ and $9^{th}$ rows of openings, etc.

The heat exchangers 80 and 120 shown in FIGS. 4-6 and 7 represent an innovative design which offers a great simplification of external plumbing, but which would be difficult to build using traditional fabrication techniques. In particular, the brazing or welding of the blockers 82 and 84 onto the ends of the fins 52 and the plates 16/18/20 would be difficult, especially considering that the materials involved are very thin, the dimensions are very small, and the seams would all have to be leak-proof. However, the heat exchangers 80 and 120 could be readily built using additive manufacturing techniques (also known as 3D printing). Additive manufacturing can be used with metals such as aluminum, and the number of faces and joints is essentially irrelevant; the geometry can simply be modeled as shown in the preceding figures, and the heat exchanger 80 or 120 would be reliably constructed.

In the case of the heat exchanger 80, it would be possible to construct the heat exchanger channel matrix via additive manufacturing, and manually fabricate the headers 90 and 100 and braze/weld them to the heat exchanger 80 in a subsequent step. In the case of the heat exchanger 120, with the large number of headers required, it would be preferable to construct the entire heat exchanger assembly—including all of the headers—via additive manufacturing. It is also noteworthy that, using additive manufacturing, the channels need not be straight. The entire heat exchanger can take on almost any arbitrary shape—including bends, twists, warping, etc.—as may be needed for heat exchanger packaging.

The use of additive manufacturing techniques enables production of the alternating channel counter-flow heat exchangers 80 and 120, where it may not have previously been practical. The alternating channel counter-flow design offers maximum heat exchanger efficiency, which allows heat exchanger size and mass to be minimized and fluid flow rates to be reduced, both of which are beneficial in any heat exchanger application.

The foregoing discussion discloses and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A heat exchanger comprising:

a matrix of channels including a plurality of rows and a plurality of columns, where half of the channels are hot flow channels through which a hot fluid flows in a first direction and half of the channels are cold flow channels through which a cold fluid flows in a second direction opposite the first direction, and hot and cold flow channels alternate in each row and each column to define an alternating channel counter-flow arrangement; and an end blocker attached at each end of each channel, where each end blocker blocks only a top portion or a bottom portion of the end of the channel to define a blocked portion and an open portion, and the blocked portions and the open portions alternate position in each row and each column.

2. The heat exchanger of claim 1 further comprising hot fluid headers attached at each end of the heat exchanger, said hot fluid headers providing a flow of the hot fluid to and from the heat exchanger, where the hot fluid headers are configured to be in fluid communication with the open portions of the hot flow channels and the blocked portions of the cold flow channels.

3. The heat exchanger of claim 2 wherein the cold fluid is air flowing in a cold air stream moving in the second direction, where the air enters the cold flow channels through the open portions of the cold flow channels, and the air is blocked from entering the hot flow channels by the end blockers on the hot flow channels and the hot fluid headers.

4. The heat exchanger of claim 2 further comprising cold fluid headers attached at each end of the heat exchanger, said cold fluid headers providing a flow of the cold fluid to and from the heat exchanger, where the cold fluid headers are configured to be in fluid communication with the open portions of the cold flow channels and the blocked portions of the hot flow channels.

5. The heat exchanger of claim 4 wherein the hot fluid and the cold fluid are both liquid.

6. The heat exchanger of claim 1 wherein each of the end blockers blocks approximately a top half or a bottom half of the end of the channel.

7. The heat exchanger of claim 1 wherein the heat exchanger is constructed of aluminum.

8. The heat exchanger of claim 1 wherein the heat exchanger is constructed via additive manufacturing.

9. An alternating channel counter-flow heat exchanger comprising:

a matrix of channels including two rows and a plurality of columns, where half of the channels are hot flow channels through which a hot fluid flows in a first direction and half of the channels are cold flow channels through which a cold fluid flows in a second direction opposite the first direction, and hot and cold flow channels alternate in each row and each column to define an alternating channel counter-flow arrangement where the hot flow channels have neighboring channels above, below and to either side which are all cold flow channels;

an end blocker attached at each end of each channel, where each end blocker blocks only a top portion or a bottom portion of the end of the channel to define a blocked portion and an open portion, and the blocked portions and the open portions alternate position in each row and each column; and a hot fluid header attached at each end of the heat exchanger, where a first hot fluid header provides a flow of the hot fluid to the heat exchanger and a second hot fluid header receives a flow of the hot fluid from the heat exchanger, and where the hot fluid headers are positioned over the bottom portion of a top row and the top portion of a bottom row and configured to be in fluid communication with the open portions of the hot flow channels and the blocked portions of the cold flow channels such that the hot fluid can only flow through the hot flow channels.

10. The heat exchanger of claim 9 wherein the cold fluid is air flowing in a cold air stream moving in the second direction, where the air enters the cold flow channels through the open portions of the cold flow channels, and the air is blocked from entering the hot flow channels by the end blockers on the hot flow channels and the hot fluid headers.

11. The heat exchanger of claim 9 further comprising cold fluid headers attached at each end of the heat exchanger, said cold fluid headers providing a flow of the cold fluid to and from the heat exchanger, where the cold fluid headers are configured to be in fluid communication with the open portions of the cold flow channels and the blocked portions of the hot flow channels.

12. The heat exchanger of claim 11 wherein the hot fluid and the cold fluid are both liquid.

13. The heat exchanger of claim 9 wherein the channels have a height which is at least 100 times greater than a width.

14. The heat exchanger of claim 9 wherein each of the end blockers blocks approximately a top half or a bottom half of the end of the channel.

15. The heat exchanger of claim 9 wherein the heat exchanger is constructed of aluminum via additive manufacturing.

16. An alternating channel counter-flow heat exchanger comprising:

a matrix of channels including a plurality of rows and a plurality of columns, where half of the channels are hot flow channels through which a hot fluid flows in a first direction and half of the channels are cold flow channels through which a cold fluid flows in a second direction opposite the first direction, and hot and cold flow channels alternate in each row and each column to define an alternating channel counter-flow arrangement where the hot flow channels have neighboring channels above, below and to either side which are all cold flow channels;

an end blocker attached at each end of each channel, where each end blocker blocks only a top portion or a bottom portion of the end of the channel to define a blocked portion and an open portion, and the blocked portions and the open portions alternate position in each row and each column;

a plurality of hot fluid headers attached at each end of the heat exchanger, including hot fluid headers which provide a flow of the hot fluid to the heat exchanger and hot fluid headers which receive a flow of the hot fluid from the heat exchanger, and where the hot fluid headers are configured to be in fluid communication with the open portions of the hot flow channels and the blocked portions of the cold flow channels such that the hot fluid can only flow through the hot flow channels; and a plurality of cold fluid headers attached at each end of the heat exchanger, including cold fluid headers which provide a flow of the cold fluid to the heat exchanger and cold fluid headers which receive a flow of the cold fluid from the heat exchanger, and where the cold fluid headers are interspersed between the hot fluid headers on the ends of the heat exchanger and configured to be in fluid communication with the open portions of the cold flow channels and the blocked portions of the hot flow channels such that the cold fluid can only flow through the cold flow channels.

17. The heat exchanger of claim 16 wherein the hot fluid headers attach to hot fluid supply lines on one side of the heat exchanger and the cold fluid headers attach to cold fluid supply lines on an opposite side of the heat exchanger.

18. The heat exchanger of claim 16 wherein the channels each have a width which is approximately equal to a height, and each of the end blockers blocks approximately a top half or a bottom half of the end of the channel.

19. The heat exchanger of claim 16 wherein the heat exchanger is constructed of aluminum via additive manufacturing.

* * * * *